US010157521B2

(12) United States Patent
Moore et al.

(10) Patent No.: US 10,157,521 B2
(45) Date of Patent: Dec. 18, 2018

(54) IDENTIFICATION OF SIDE POT PARTICIPANTS IN POKER GAME

(71) Applicant: Zynga Inc., San Francisco, CA (US)

(72) Inventors: Jacob Moore, Alameda, CA (US); Stacey Adams, San Francisco, CA (US); Justin Rouse, San Francisco, CA (US); Theodore Marston, San Francisco, CA (US)

(73) Assignee: Zynga Inc., San Francisco, CA (US)

( * ) Notice: Subject to any disclaimer, the term of this patent is extended or adjusted under 35 U.S.C. 154(b) by 253 days.

(21) Appl. No.: 14/170,160

(22) Filed: Jan. 31, 2014

(65) Prior Publication Data

US 2015/0221179 A1 Aug. 6, 2015

(51) Int. Cl.
*G07F 17/32* (2006.01)

(52) U.S. Cl.
CPC ..... *G07F 17/3293* (2013.01); *G07F 17/323* (2013.01); *G07F 17/3244* (2013.01)

(58) Field of Classification Search
CPC ..... G07F 17/3293
USPC ..... 463/10, 12, 13, 15
See application file for complete search history.

(56) References Cited

U.S. PATENT DOCUMENTS

| | | | | |
|---|---|---|---|---|
| 5,755,621 | A | 5/1998 | Marks et al. | 463/42 |
| 5,833,540 | A | 11/1998 | Miodunski et al. | 463/42 |
| 5,971,849 | A | 10/1999 | Falciglia | 463/16 |
| 6,039,648 | A | 3/2000 | Guinn et al. | 463/16 |
| 6,077,162 | A | 6/2000 | Weiss | 463/26 |
| 6,450,500 | B1 | 9/2002 | Miller | 273/292 |
| 7,066,465 | B2 | 6/2006 | Daines | 273/292 |
| 7,255,351 | B2 | 8/2007 | Yoseloff et al. | 273/274 |
| 8,459,650 | B2 | 6/2013 | Baseel | 273/292 |
| 8,727,850 | B2 | 5/2014 | Burnside et al. | 463/13 |
| 2002/0045474 | A1 | 4/2002 | Singer et al. | 463/20 |
| 2003/0222400 | A1 | 12/2003 | Collins et al. | 273/274 |
| 2005/0054446 | A1 | 3/2005 | Kammier et al. | 463/42 |
| 2005/0253338 | A1 | 11/2005 | Daines | 273/292 |
| 2007/0129123 | A1* | 6/2007 | Eryou | A63F 13/12 463/1 |
| 2007/0210519 | A1* | 9/2007 | Barlev | A63F 3/00157 273/292 |
| 2012/0074647 | A1 | 3/2012 | Hall | 273/274 |

* cited by examiner

*Primary Examiner* — Dmitry Suhol
*Assistant Examiner* — Brandon Gray
(74) *Attorney, Agent, or Firm* — Martine Penilla Group, LLP

(57) ABSTRACT

Methods, systems, and computer programs are presented for providing information in a poker game. One method includes operations for providing an interface to a player for playing a poker game, and for detecting the creation of a side pot in the poker game during play. The side pot is presented in a first format, which includes the amount of the side pot. Additionally, the method includes an operation for detecting a selection by the first player in the poker game requesting additional information about the side pot. In response to the selection, the side pot is presented in a second format, which has the amount of the side pot and one icon for each of the players participating in the side pot, where players absent from the side pot are not represented in the second format.

23 Claims, 11 Drawing Sheets

IDENTIFICATION OF SIDE POT PARTICIPANTS IN POKER GAME

CLAIM OF PRIORITY

This application claims priority from U.S. Provisional patent application Ser. No. 17/792,198, filed Dec. 31, 2013, and entitled "IDENTIFICATION OF SIDE POT PARTICIPANTS IN POKER GAME." This provisional application is herein incorporated by reference.

BACKGROUND

1. Field of the Invention

The present invention relates to methods for improving user experience in a poker game, and more particularly, methods, computer programs, and systems for improving the presentation of game interactions during play.

2. Description of the Related Art

Online games that allow players to interact with other players have become popular. Some online games, such as online poker, fantasy games, online chess, etc., may have millions of players playing the game simultaneously, although the players may be organized in groups that play in playing areas (e.g., a poker table) that host a limited number of players at a time.

When many players participate in the same game, such as in a hand of poker (e.g., 8 or 9 players around a poker table) a player may feel that the game is moving too slow if the player has to wait a long time for her turn, or wait a long time to complete a hand. In order to increase customer satisfaction for demanding players that require quick play, poker games sometimes include timers to limit the amount of time that a player has to bet. In addition, the assignment of winnings at the end of a hand is usually done quickly, and sometimes players need to check a log to see what happened.

In poker, when side pots are created, players may be confused because the players may not understand well who are the players participating in a side pot created during a hand as a result of a player going all in.

It is in this context that embodiments arise.

SUMMARY

Methods, systems, and computer programs are presented for providing information in a poker game. It should be appreciated that the present embodiments can be implemented in numerous ways, such as a method, an apparatus, a system, a device, or a computer program on a computer readable medium. Several embodiments are described below.

In one embodiment, a method includes operations for providing an interface to a player for playing a poker game, and for detecting the creation of a side pot in the poker game during play. The side pot is presented in a first format, which includes the amount of the side pot. Additionally, the method includes an operation for detecting a selection by the first player in the poker game requesting additional information about the side pot. In response to the selection, the side pot is presented in a second format, which has the amount of the side pot and one icon for each of the players participating in the side pot, where players absent from the side pot are not represented in the second format.

In another embodiment, a method includes operations for providing an interface to a first player for playing a poker game, and for detecting the creation of a first side pot and a second side pot in the poker game during play. In addition, the method includes an operation for presenting the first side pot and the second side pot in a first format, where the first format includes the amount of the respective side pot. When a selection is detected by the first player in the poker game requesting additional information about the first side pot, the first side pot is presented in the second format. The second format has the amount of a respective side pot and one icon for each of the players participating in the respective side pot, and players absent from the respective side pot are not represented in the second format.

In yet another embodiment, a non-transitory computer-readable storage medium storing a computer, the computer-readable storage medium comprising program instructions for providing an interface to a first player for playing a poker game, and program instructions for detecting the creation of a side pot in the poker game during play. Further, the storage medium includes program instructions for creating an interactive area in the interface associated with the side pot. The interactive area presents a compact format with information about the side pot, the compact format including an amount of the side pot. Further, the storage medium includes program instructions for presenting, in response to a selection by the first player in the poker game, the interactive area in an expanded format. The expanded format includes the amount of the side pot and one icon for each of the players participating in the side pot, where players absent from the side pot are not represented in the expanded format.

Other aspects will become apparent from the following detailed description, taken in conjunction with the accompanying drawings.

BRIEF DESCRIPTION OF THE DRAWINGS

The embodiments may best be understood by reference to the following description taken in conjunction with the accompanying drawings.

DETAILED DESCRIPTION

The following embodiments describe methods, systems, and computer programs for providing information in a poker game. It will be apparent, that the present embodiments may be practiced without some or all of these specific details. In other instances, well known process operations have not been described in detail in order not to unnecessarily obscure the present embodiments.

Figure 1:
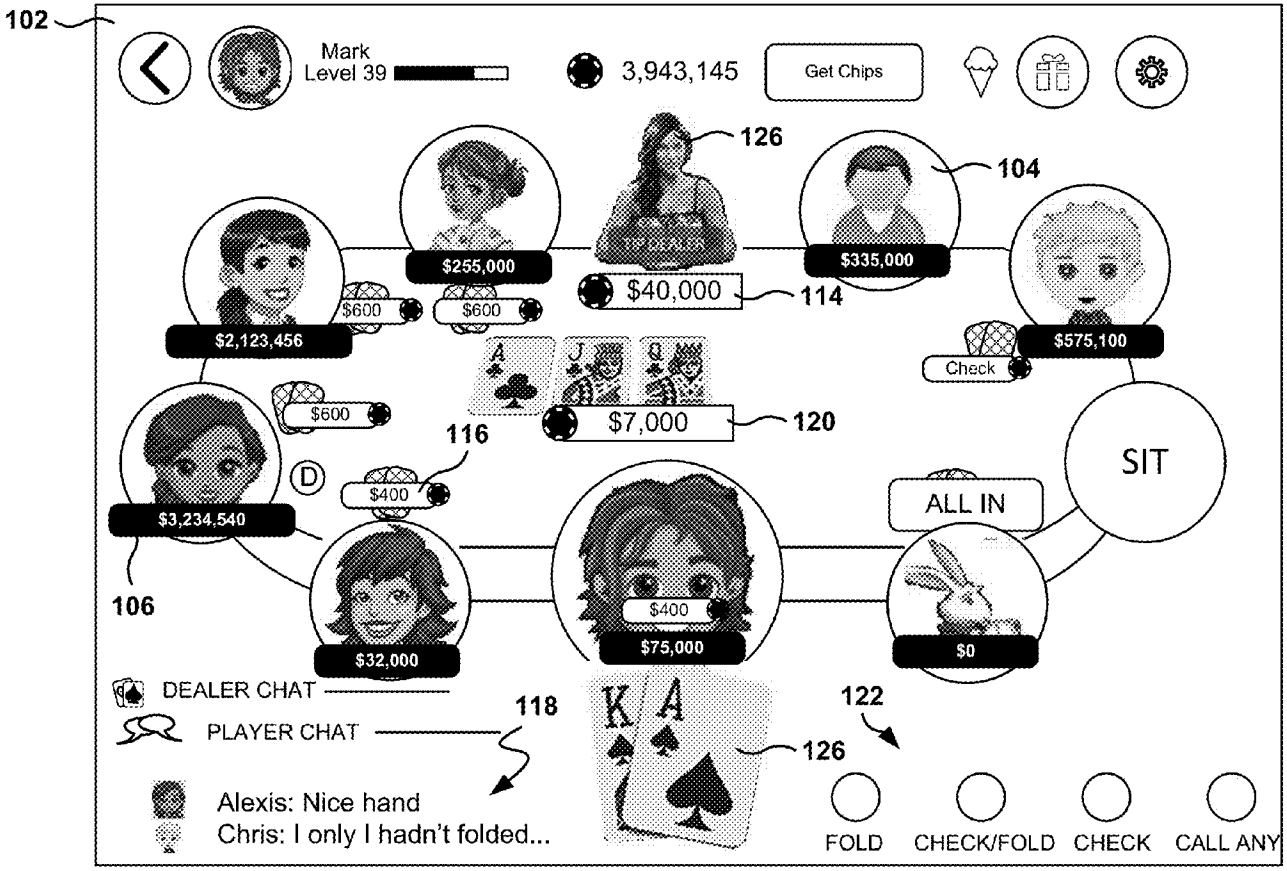
FIG. 1 illustrates an embodiment of a web page for playing a poker game.

FIG. 1 illustrates an embodiment of a webpage 102 for playing a poker game. The online poker game may be accessed in a website of the publisher of the online poker game, or the online poker game may be embedded within the webpage of a social networking site, or may be an application loaded and executed to play the poker game.

In one embodiment, the poker game is played with virtual chips, which may be purchased with real cash, and chips may be won or lost while playing the online poker game. In another embodiment, the poker game is played with real money, and the chips represent a respective amount of gambling money. The virtual or real-money currency may also be utilized to buy items in the online game area.

The poker table is surrounded by players 104. When a player enters the poker room, the player selects an empty seat to "sit" in that spot. For each player, the game displays the amount of chips 106 available to the player at the table, the amount bet in this hand 116, and, for the player playing the game, the cards 126 held in this hand. Embodiments are presented for a game of Texas HoldEm Poker, but the embodiments may be used for any type of poker game or betting games where side pots may be created.

When the hand starts, the main pot 114 is created. As used herein, the main pot is the first pot created in the hand and all the players participate in the main pot, at least until a player is "all in." All-in for a player occurs when the player bets all his money available at the table. In one embodiment, the total amount of the main pot 114 is presented below dealer 126.

In many poker games, players can only bet in one hand the money the players have put on the table. If the player runs out of money to bet, the player can not add additional chips by going to his bank of chips or borrowing from other players. If a player bets all her money (i.e., the player goes "all-in") and other players continue betting beyond the amount that put the player all-in, then a side pot 120 is created. The side pot includes all the money that the player that went all-in could win, i.e., all the money bet until the player went all-in, and including bets by other players to cover the all-in bet.

After the side pot is created, the players that have not folded and still have money to bet may continue betting on a separate side pot. Additional side pots may be created if a second player goes all-in, and there are other players that continue betting past the second all-in bet. It is noted that if a player with money to bet folds, then the player that folds loses her rights to all the pots on the table.

A chat area 118 enables the users to exchange text messages. The messages may be sent to the whole table or to a particular player. In addition, webpage 102 includes a betting area 122 for entering bets, folding, or checking during play.

It is noted that the embodiments illustrated in FIG. 1 are exemplary. Other embodiments may utilize different poker room layouts, different location for the side pots, different ways of betting, etc. In addition, the embodiments presented herein with reference to a poker game may also be used for any betting game that may create side pots. The embodiments illustrated in FIG. 1 should therefore not be interpreted to be exclusive or limiting, but rather exemplary or illustrative.

Figure 2:
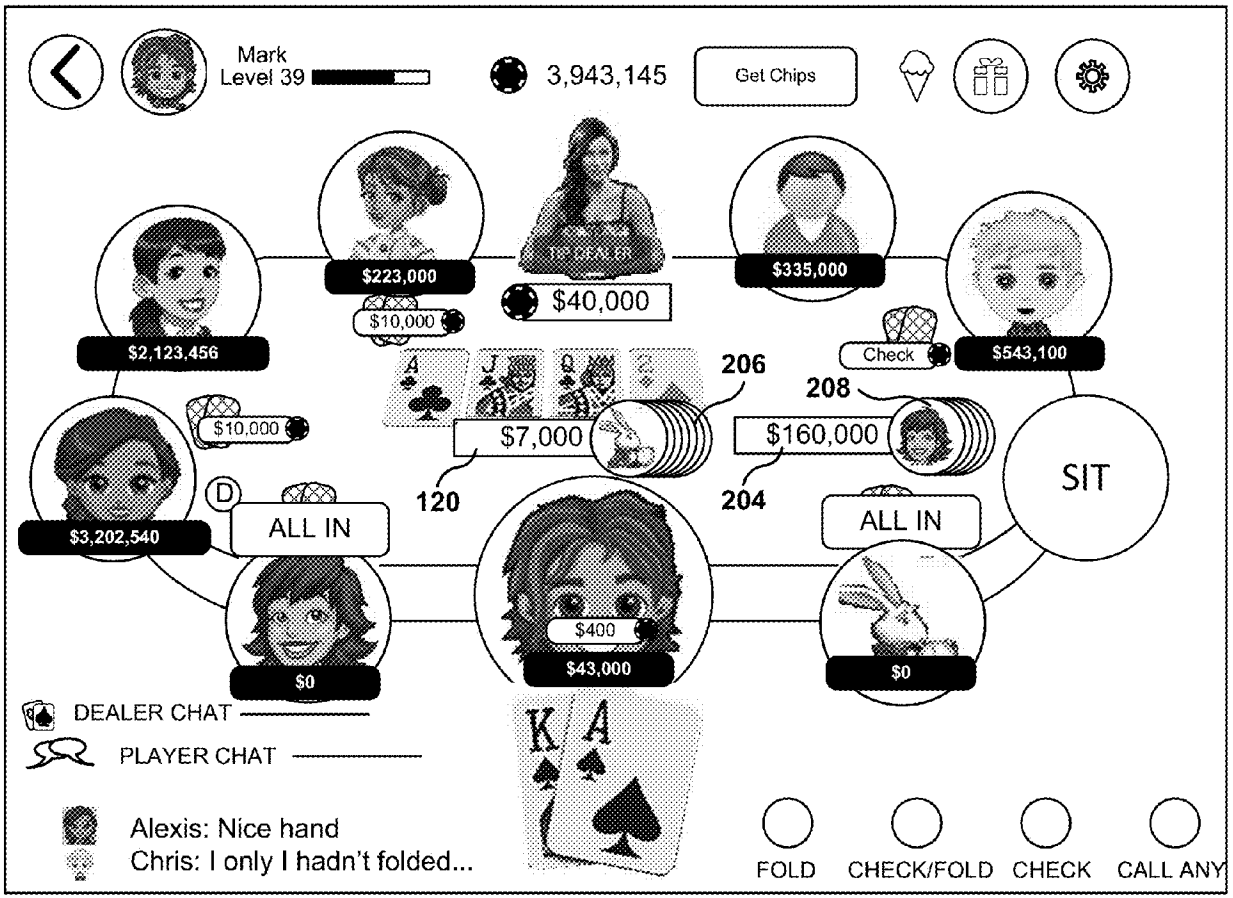
FIG. 2 illustrates a poker game with two side pots, according to one embodiment.

FIG. 2 illustrates a poker game with two side pots, according to one embodiment. In the embodiment of FIG. 1, the only information presented about the side pot is the total amount of the pot. However, players do not have visibility to which players are vying for the pot. In one embodiment, during play the game identifies which players are still in the hand, while players that have folded are presented in a different manner to let the players know who is still playing.

In some games, the players participating in the side pot are shown at side-pot creation time, but after the initial setup of the side pot, players do not have access to this information. Sometimes, poker action is fast and if the player did not see who belongs in the side pot, then there is no way for the player to know the players betting in the side pot.

In the poker game of FIG. 2, two side pots 120, 204 have been created during a poker hand. Each side pot includes a stack of icons 206, 208, where each icon is associated with one of the players in the side pot. In one embodiment, the player at the top of the stack is the player that went all-in to create the side pot. In other embodiments, any player may be at the top of the stack. This representation of the players in a side pot, where the player icons are stacked, is referred to herein as a compact format, or compact presentation, of the side pot. Therefore, the compact format includes the total amount of the side pot and a stack of icons associated with players of the side pot.

In one embodiment, the player gets information about the number of participants in the side pot because of the size of the stack. The more players that are in the side pot, the larger the stack of icons will be.

It is noted that the embodiments illustrated in FIG. 2 are exemplary. Other embodiments may utilize different locations for the side pot around the poker table, use different icons, or present the number of participants in a different way (e.g., a counter next to the side pot amount showing the number of participants). The embodiments illustrated in FIG. 2 should therefore not be interpreted to be exclusive or limiting, but rather exemplary or illustrative.

Figure 3:
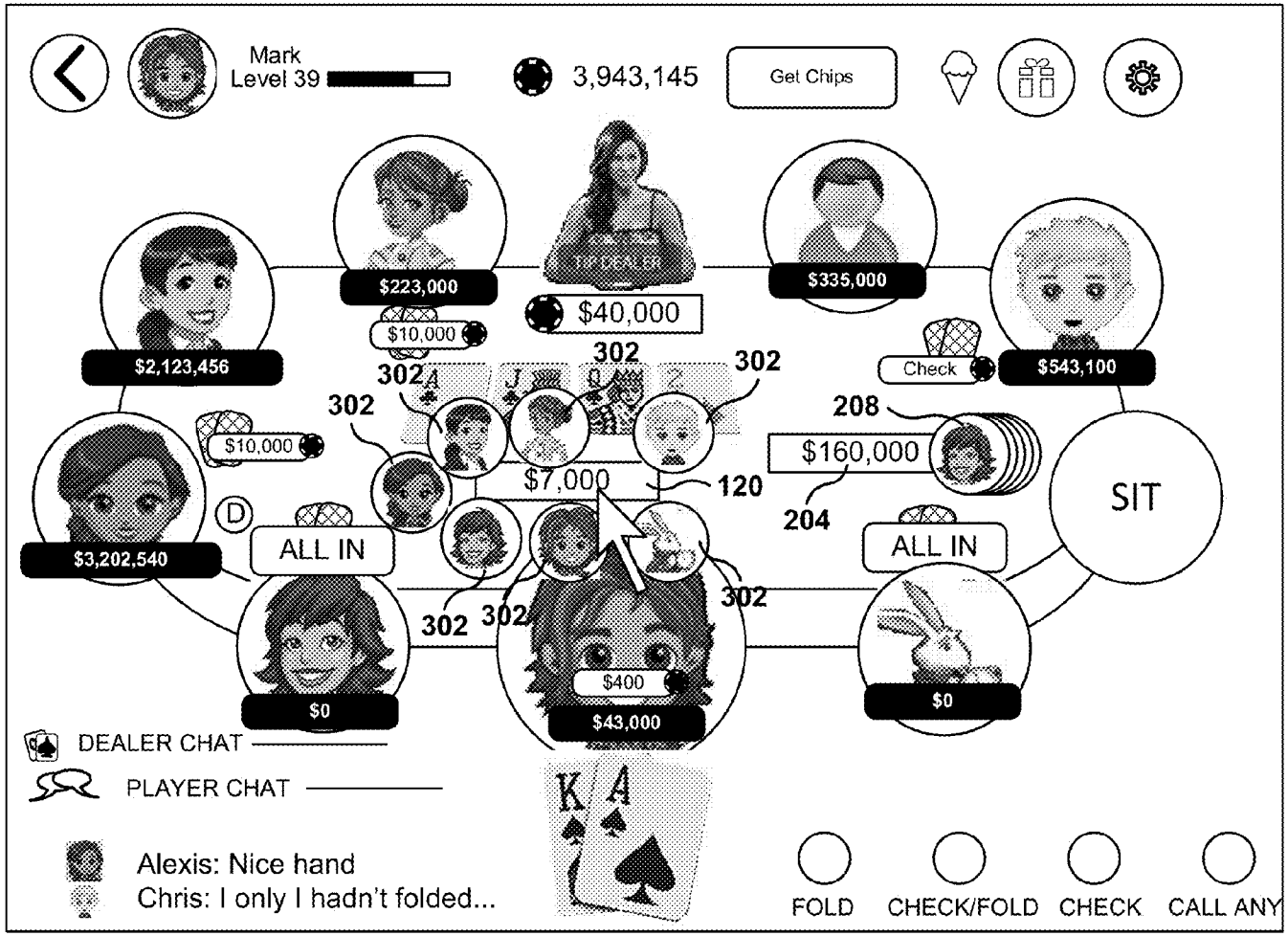
FIG. 3 illustrates an animation for presenting information about the players in a side pot, according to one embodiment.

FIG. 3 illustrates an animation for presenting information about the players in a side pot, according to one embodiment. In one embodiment, when the player clicks with the mouse on the side pot 120, an animation takes place to distribute the player icons 302 around the side pot. For example, the animation includes moving the icons from the stack 206 of FIG. 2 to their presentation around the pot of FIG. 3. Of course, only the icons of players that belong to the side pot are presented while icons of players absent from the pot are not present. In one embodiment, the location of the player icons around the side pot is in the same order as the player icons around the poker table. In another embodiment, the animation takes place when the mouse pointer hovers over the side pot 120.

As used herein, the presentation format for the side pot with the icons around the pot amount is referred to as an expanded format or detailed format, or that the side pot is said to be "open." Therefore, the expanded format includes the side pot amount and icons 302 of the players participating in the side pot 120. As used herein, a side pot in the compact format is said to be "closed."

In one embodiment, the icons of the players correspond to a profile picture provided by each player in a social network or in a profile of the player in the game, or in a profile of the player for a website of the game provider.

In the embodiment of FIG. 3, when the player clicks on the side pot 120, the other side pot 204 does not change presentation format, but in other embodiments, other side pots may also be expanded to a detailed format.

It is noted that the embodiments illustrated in FIG. 3 are exemplary. Other embodiments may utilize different animations, presentations of players (e.g., names of the players), include a numerical counter of the players, etc. The embodiments illustrated in FIG. 3 should therefore not be interpreted to be exclusive or limiting, but rather exemplary or illustrative.

Figure 4A:
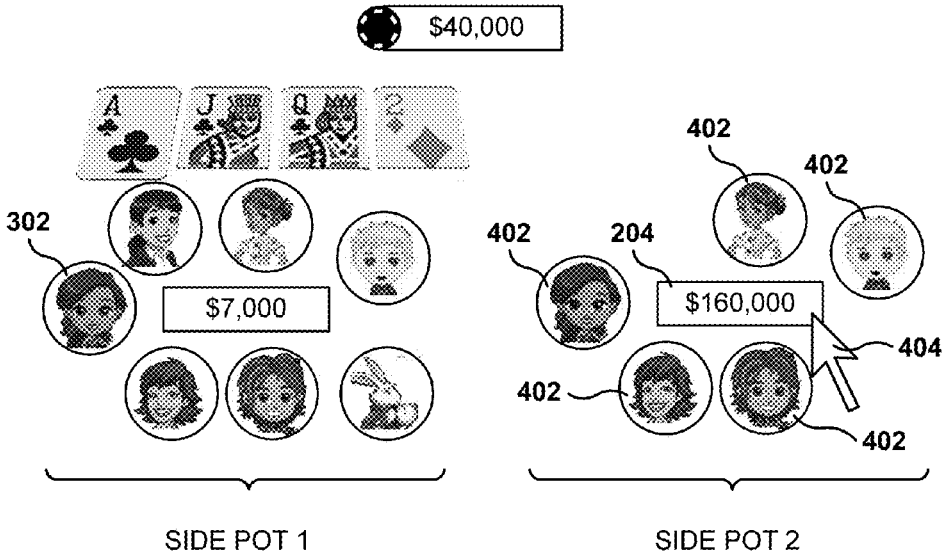
FIG. 4A illustrates the animation for presenting the players of a second side pot, according to one embodiment.

FIG. 4A illustrates the animation for presenting the players of a second side pot, according to one embodiment. In one embodiment, each side pot is animated independently of the animations of other side pots. Or in other words, when a player selects a side pot, the side pot is animated while the remainder of the side pots remains in the same format.

The animation is associated with the change in format of the side pot: changing from a compact format to an expanded format, or changing from an expanded format to a compact format. FIG. 4A presents detail of the side pots of FIG. 3. As described above with reference to FIG. 3, when the player selects side pot number 1, then side pot 1 is animated to change into an expanded format.

If the player selects side pot 2, then side pot 2 changes from the compact format to the expanded format with an animation. In the exemplary embodiment of FIG. 4A, side pot 204 includes 5 players 402.

In some embodiments, the format of the side pots does not change until the player performs a new selection, either of the same side pot or another side pot. However, in other embodiments a timer is provided for the amount of time that the side pot is presented in the expanded format. The timer may be useful when there is a lot of clutter on the poker table, which may due to the presence of several side pots currently active, many bets going, many players still in the game, etc.

In yet another embodiment, the format is reset to compact format for all side pots every time a new card is dealt.

Figure 4B:
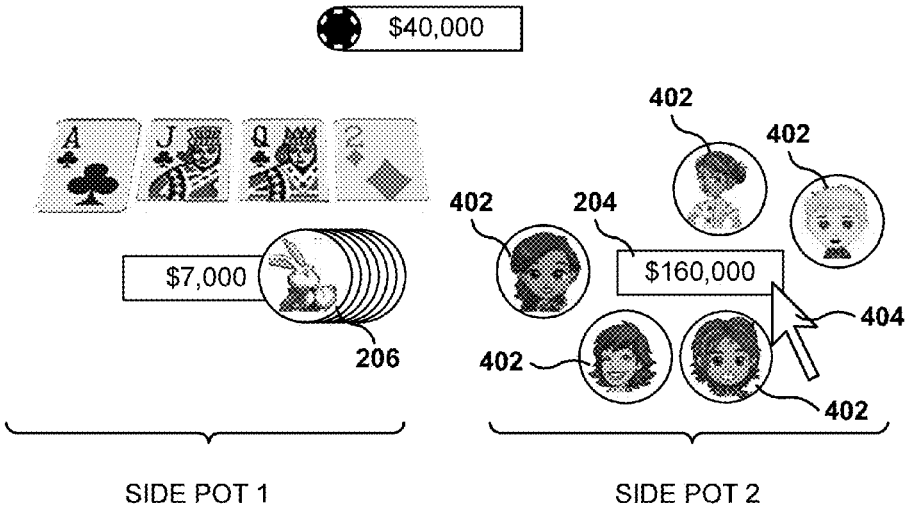
FIG. 4B illustrates the expanding of the second side pot and the compact format for the first side pot, according to one embodiment.

FIG. 4B illustrates the opening of the second side pot and the closing of the first side pot, according to one embodiment. In another embodiment, only one side pot is opened at a time (i.e., presented in expanded format). This means that if a side pot is open and the player selects another side pot that is closed, then the selected side pot is opened and the side pot that was open is then closed.

In the embodiment of FIG. 4B, side pot 1 was open and when the player selected 404 side pot 2, then side pot 1 reverts to the compact format, and side pot 2 goes through an animation to be presented in expanded format. If there are more than two side pots, then the selection of one side pot causes the selected side pot to be opened and the remainder of the side pots to be closed.

It is noted that if a player folds during play, the icon of the player is eliminated from any side pot: in open side pots with the player that folded, the player's icon is eliminated from the side pot, and if a closed side pot has the icon of the player at the top of the stack, then the icon on the top of the stack is replaced with the icon of another player that is still in the hand.

Figure 4C:
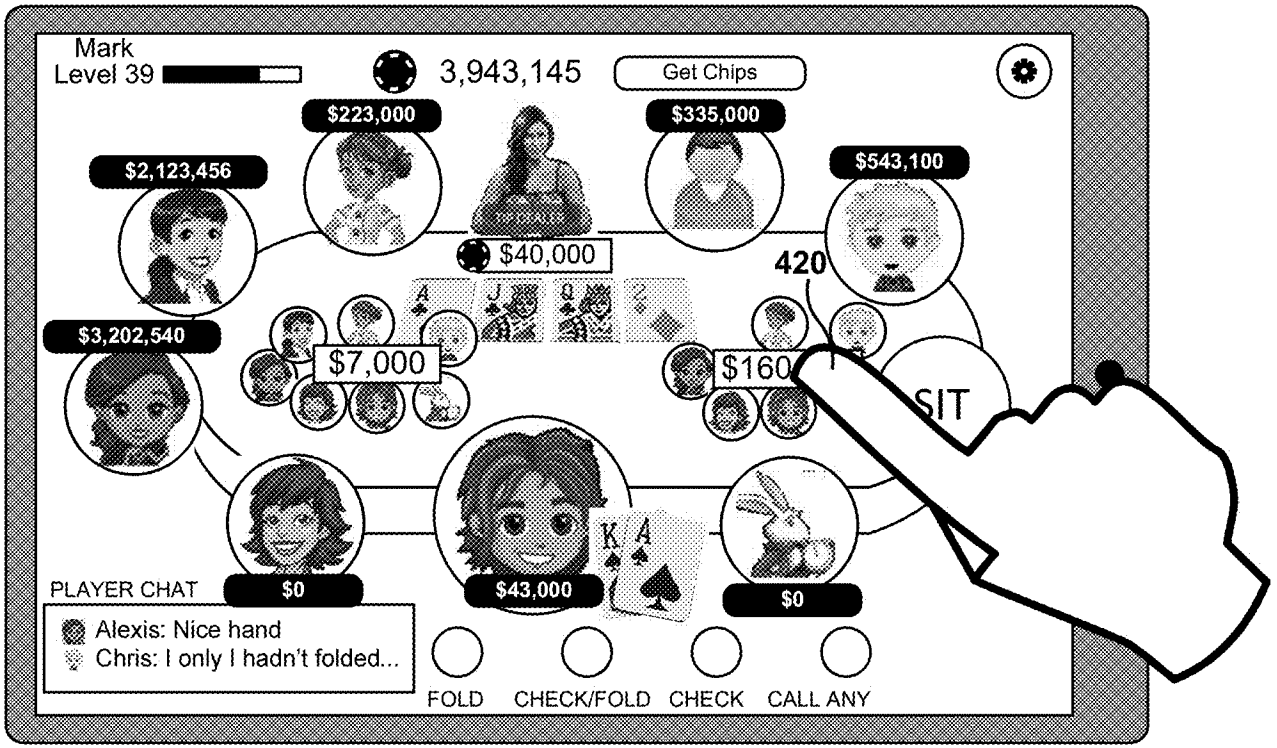
FIG. 4C illustrates an interface for a portable device having a touchscreen, according to one embodiment.

FIG. 4C illustrates an interface for a portable device having a touchscreen, according to one embodiment. Some embodiments described herein refer to the selection of the side pot using a mouse, but other embodiments may use any type of tool that allows the user to perform a selection. For example, the user may use a keyboard, a touchscreen, a gesture (which is recognized via image analysis of images taken with a camera facing the user), a remote control, a button on a peripheral (e.g., a button on a headset), a button on a mobile device, a voice command (e.g., "open side pots"), etc.

In one embodiment, the keyboard may be used to open side pots. For example, one key may be defined (e.g., "S") to open all side pots. In another embodiment, a key is defined to open one side pot, and every time the key is pressed, another side pot is opened. As discussed above, in some embodiments only one side pot is open at a time, while in other embodiments each time the key is pressed a new side pot is opened while leaving other side pots that were open in the open state.

In some embodiments, voice recognition is used to open side pots. The game may be defined to understand several side-pot related verbal commands. For example, the voice recognition system may understand the following commands: "open side pots," "open first side pot," "open my side pots," "close side pots," "open next side pot," etc.

The embodiment of FIG. 4C illustrates a portable device (e.g., a tablet, a smart phone, etc.) with a touchscreen. When a player touches 421 of the side pots, the animation takes place to change the state of the side pot: if the side pot was open then the side pot is closed, and if the side pot was closed then the side pot is opened. As discussed above, different embodiments will have different animations and may open or close one at a time or all at the same time.

Figure 4D:
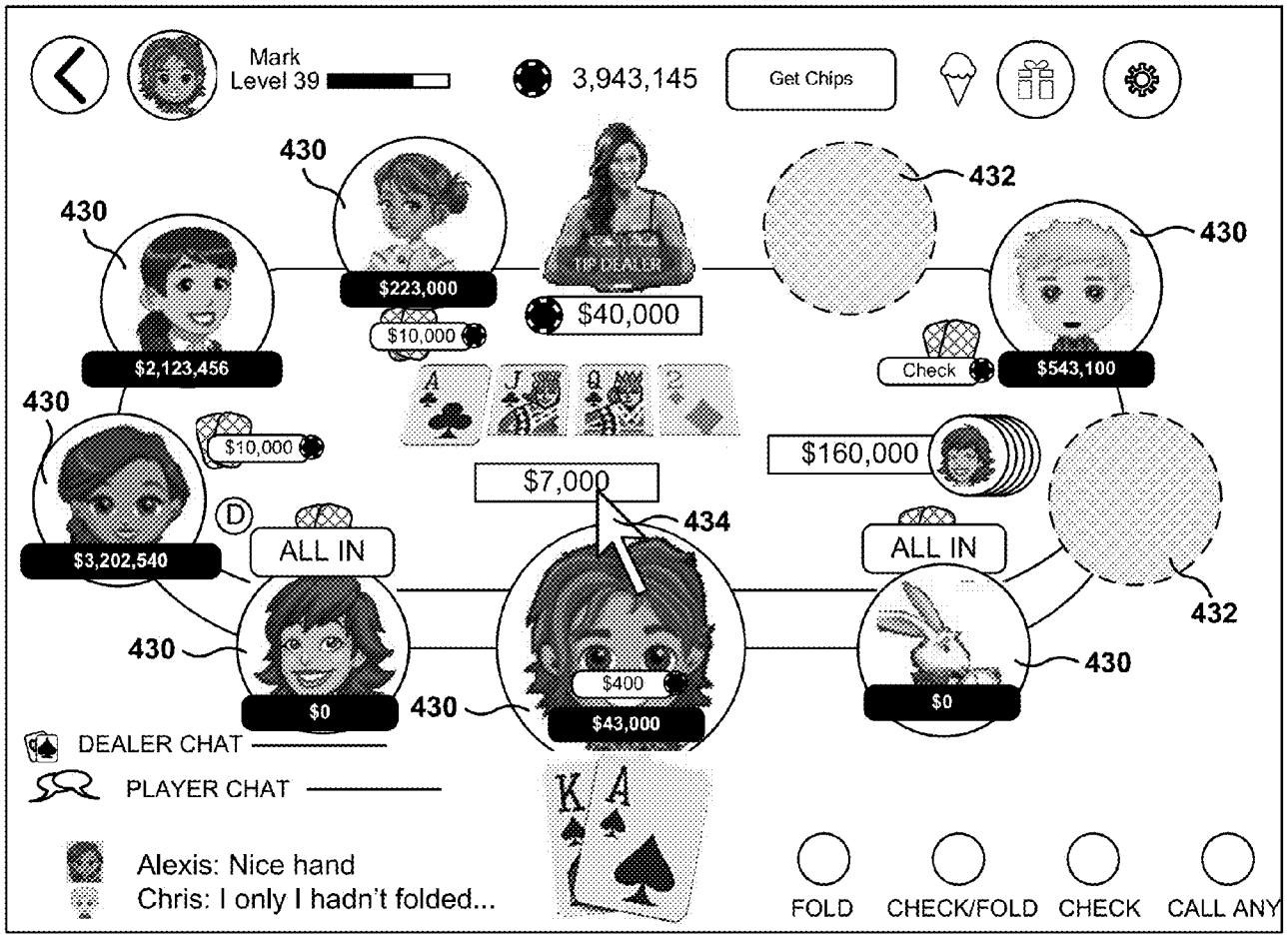
FIG. 4D illustrates an interface for presenting the players in a side pot by hiding players not participating in the side pot, according to one embodiment.

FIG. 4D illustrates an interface for presenting the players in a side pot by hiding players not participating in the side pot, according to one embodiment. The embodiments described above present information about side-pot participants by displaying information around the side pot. However, other embodiments may use any type of animation that describes or illustrates which players are in the side pot and which players are out.

In the embodiment of FIG. 4D, the side pot participants are identified by changing the format of their respective icon around the poker table. When a player selects 434 the side pot (e.g., hovers the mouse pointer over the side pot, or clicks on the side pot), the icons of players in the side pot remain on the screen while the icons of the players out of the side pot are hidden or dimmed 432.

In other embodiments, the participant players may have other types of identifiers, such as a circle around their icon, a square around their icon, a star next to their name or their bank, etc. On the other hand, players that are out of the side pot may remain in the same state or change to a lesser representation, such as shrinking their icon, completely disappearing from the poker table, having an X over their face, having a diagonal line over their icon, etc.

Figure 5:
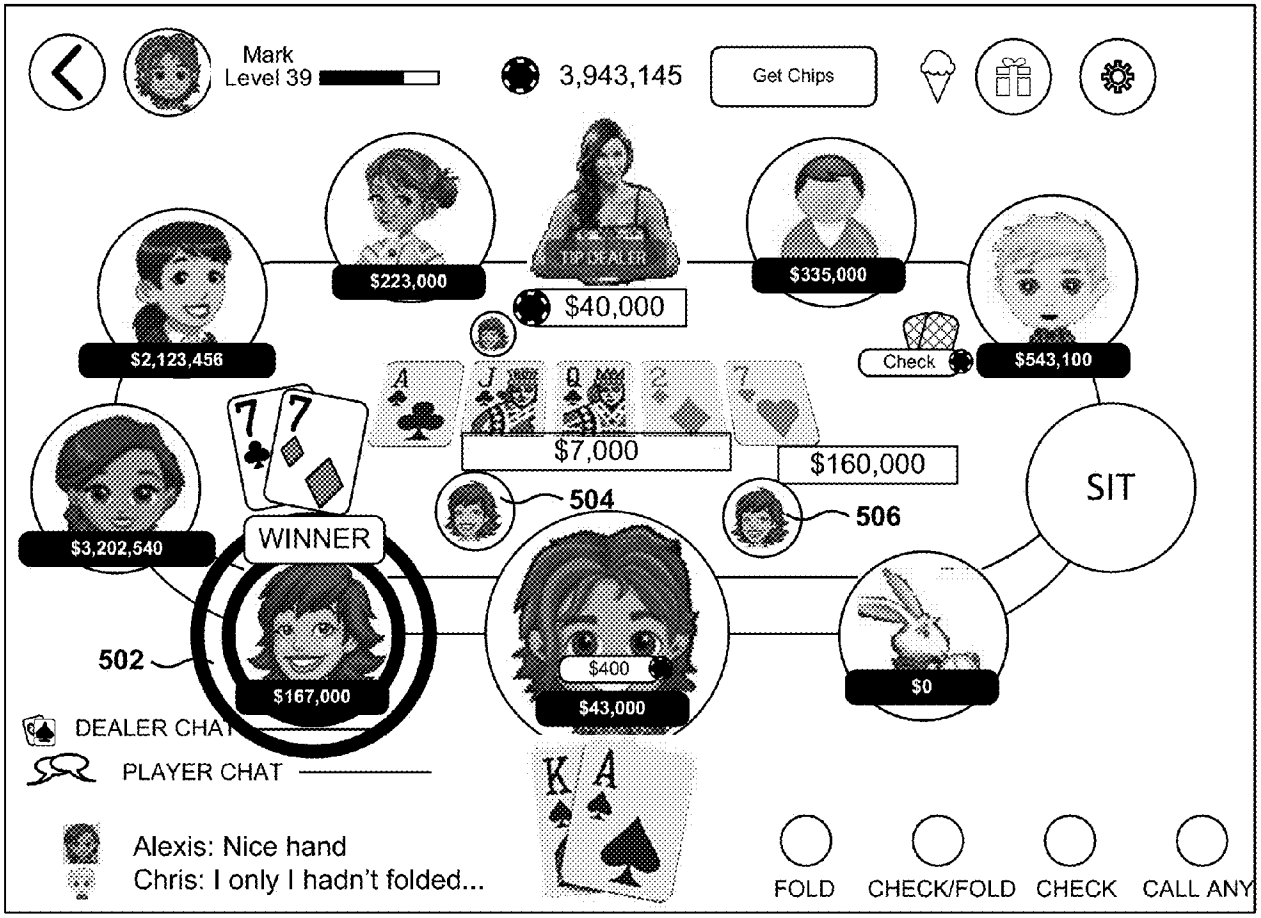
FIG. 5 illustrates an interface for awarding the side pots to the winner at the end of the hand, according to one embodiment.

FIG. 5 illustrates an interface for awarding pots to the winner or winners at the end of the hand, according to one embodiment. At the end of a poker hand, the game gives the winning hand or hands their corresponding pot winnings. When there are several side pots, the delivery of the winning pots is usually very fast, and sometimes a player may miss some of the outcomes, which include showing the winning hands and the winners.

In one embodiment, an animation takes place to show the winner, not only of the main pot but also of the side pots. Initially, the winner of each side pot 504, 506 have their icon shown next to the side pot. This provides a quick visual representation of the winner for each pot.

Additionally, the game cycles to each of the pot winners and performs an animation to give the pot money to the winners, flowing from the respective pot towards the bank of each winner. In the exemplary embodiment of FIG. 5, player 502 has won the main pot and the side pots. While the money from each pot is delivered, the winning player 502 is highlighted (e.g., with a circle or circles around the winner). Of course, there could be several winners, and in that case the respective icons will be shown next to each pot.

Figure 6A:
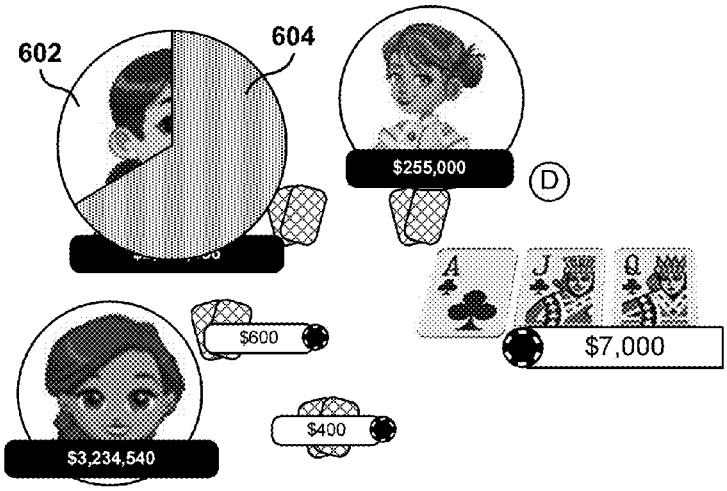
FIGS. 6A-6C illustrate embodiments for identifying the player with the turn to bet and the amount of time left for placing the bet.
Figure 6B:
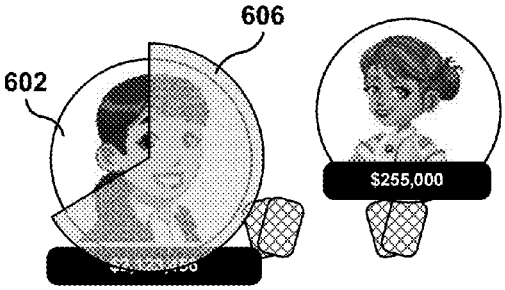
Figure 6C:
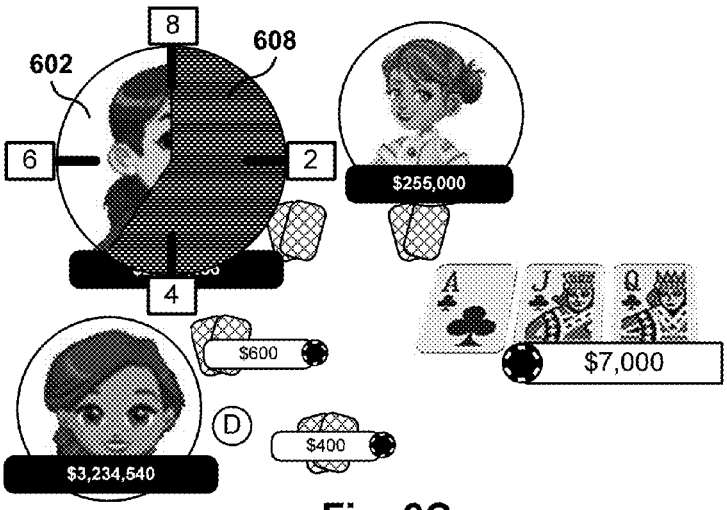

FIGS. 6A-6C illustrate embodiments for identifying the player with the turn to bet and the amount of time left for placing the bet. In some poker games time is critical. Some games limit the amount of time that a player has to bet in order to speed up the game, because if the amount of time given to each player is large, then players may get frustrated waiting for the hand to advance. This is why some poker games are given labels such as fast, quick, experienced, etc., to allow players that like quick action to enjoy the game.

Some betting timers can be subtle, such as by providing a timer somewhere on the display, or a timer placed next to the icon of the user. However, these types of timers may be difficult to follow sometimes. It becomes especially critical to a player to make sure that the player sees the timer when it is the player's turn to bet.

In the embodiment of FIG. 6A, the timer 604 is over imposed on the icon 602 of the player. When the turn of the player begins, the icon 602 of the player is completely visible, and as the time progresses the timer starts filling up the icon 602 in circular fashion. When the icon 602 is completely covered by the timer 604, the turn of the player has expired. In one embodiment, if the player has the option to check, the game will assume that the player has checked. If the player has to respond to a bet from another player, the game will consider that the player has folded if the player has not respond within the allotted time.

By providing a timer that covers the complete icon of the player, the game uses a lot of display space for the timer, thereby improving the timer's visibility. In general, other types of timers may be used that occupy the area provided around the poker table for the player. In the embodiment of FIG. 6B, the timer is transparent, or semi-transparent. For example, timer 606 grows in size as time ticks, as described above with reference to FIG. 6A. However, timer 606 provides a degree of transparency so the icon of the player still has some visibility. Different levels of transparency may be used, in the range from 10% to 99%.

In addition, the timer maybe even larger than the icon of the player. For example, timer 606 occupies a larger space than the icon 602. In other embodiments, the timer may be smaller than the icon. For example, the timer may occupy a circle within the icon that might be in the range of 5% to 99% of the radius of the icon. Of course, in other embodiments where the icon is not circular, the timers may also be overimposed on other geometrical shapes, such a square or rectangle.

In one embodiment, if the icon of the player is rectangular, the timer may be also rectangular or may be also a circle within, or around, the rectangular icon.

In other embodiments, the timer includes an animation where a geometrical shape (e.g., a square, a circle, an hourglass, a rectangle, etc.) gets filled at a speed proportional to the time elapsed. In some embodiments, the geometrical shape gets filled with sand, or with water, or just filled up with a different color.

In the embodiment of FIG. 6C, the timer may also include numerical values identifying the amount of time left. For example, the timer may have clock-type markers indicating the amount of seconds available to the player for betting. For example, in the embodiment of FIG. 6C, the player has eight seconds to place a bet. Markers around timer 608 indicate when two seconds have elapsed, four seconds, six seconds, etc. In another embodiment, the markers on the timer count time downwards. In yet another embodiment, a clock with a numerical indicator of the time left may be over imposed on the circular timer.

It is noted that the embodiments illustrated in FIGS. 6A-6C are exemplary. Other embodiments may utilize different timers, shape of the timers, occupy a fraction of the player's icon, have different time markers, utilize markers indicating how much time is left, etc. The embodiments illustrated in FIGS. 6A-6C should therefore not be interpreted to be exclusive or limiting, but rather exemplary or illustrative.

Figure 7:
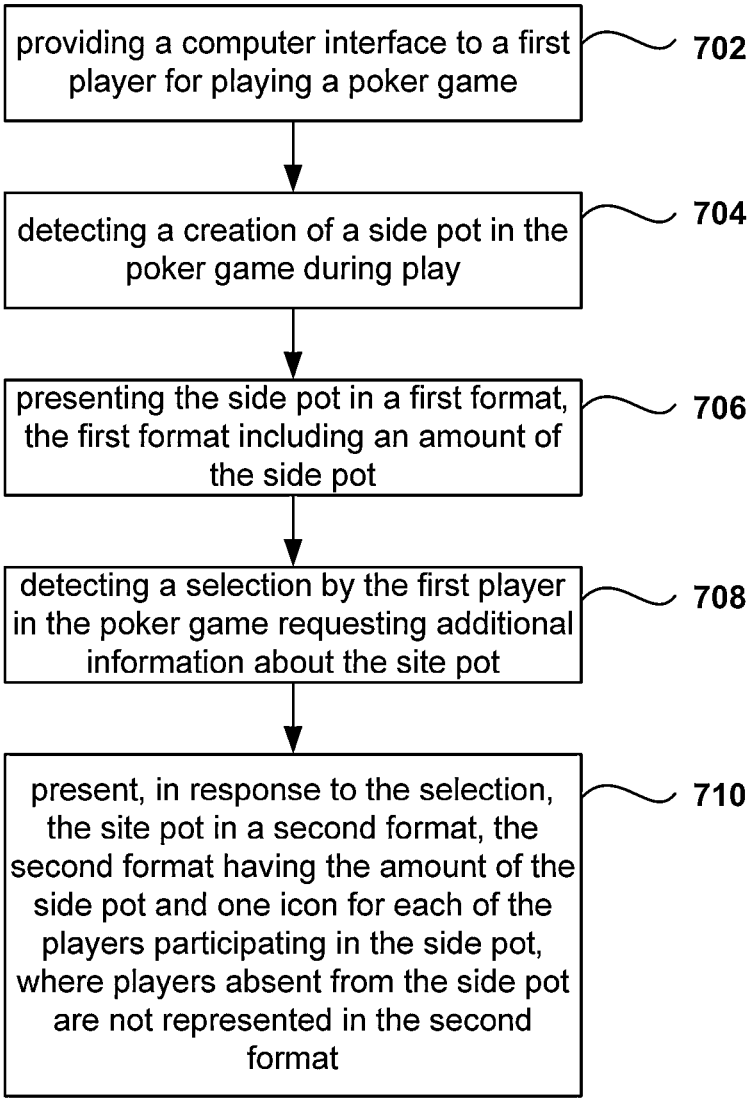
FIG. 7 is a flowchart illustrating an algorithm for providing information in a poker game, according to one embodiment.

FIG. 7 is a flowchart illustrating an algorithm for providing information in a poker game, according to one embodiment. While the various operations in this flowchart are presented and described sequentially, one of ordinary skill will appreciate that some or all of the operations may be executed in a different order, be combined or omitted, or be executed in parallel.

In operation 702, an interface is provided at first player for playing a poker game (see for example the embodiments of FIGS. 1-3, 4A-4D, 5, 6A-6C).

From operation 702, the method flows to operation 704 where the creation of the side pot is detected in the poker game during play (e.g., side pots 120, 204 of FIG. 2). The side pot is presented, in operation 706, in a first format that includes the amount of the side pot.

From operation 706 the method flows to operation 708, where a selection by the first player is detected in the poker game. The selection is for a request of additional information about the side pot. For example, the additional information may include a list or a graphical representation of the participants in the side pot.

From operation 708 the method flows to operation 710, where the side pot is presented in a second format in response to the selection (e.g., side pot 120 of FIG. 3). The second format includes the amount of the side pot and one icon for each of the players participating in the side pot. Each of the icons is associated with a respective poker player. The players absent from the side pot are not represented in the second format, which may also be referred to as expanded format in one embodiment.

Figure 8:
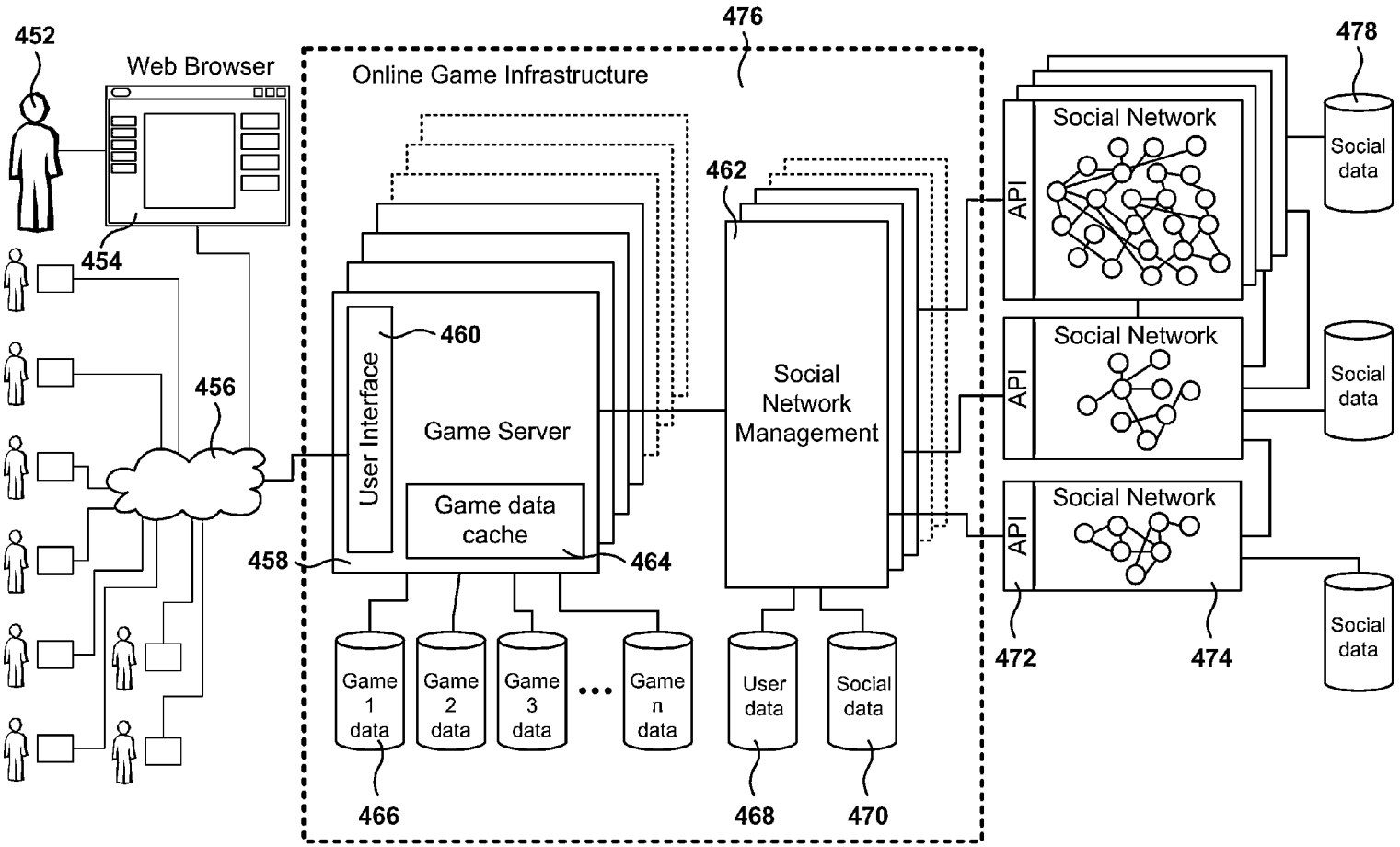
FIG. 8 illustrates an implementation of a Massively Multiplayer Online (MMO) infrastructure, according to one embodiment.

FIG. 8 illustrates an implementation of an online game infrastructure, according to one embodiment. The online game infrastructure 476 includes one or more game servers 458, web servers (not shown), one or more social network management servers 462, and databases to store game related information. In one embodiment, game server 458 provides a user interface 460 for players 452 to play the online game. In one embodiment, game server 458 includes a Web server for players 452 to access the game via web browser 454, but the Web server may also be hosted in a server different from game server 458. Network 456 interconnects players 452 with the one or more game servers 458.

Each game server 458 has access to one or more game databases 466 for keeping game data. In addition, a single database can store game data for one or more online games. Each game server 458 may also include one or more levels of caching. Game data cache 464 is a game data cache for the game data stored in game databases 466. For increased performance, caching may be performed in several levels of caching. For instance, data more frequently used is stored in a high priority cache, while data requiring less access during a session will be cached and updated less frequently.

The number of game servers 458 changes over time, as the gaming platform is an extensible platform that changes the number of game servers according to the load on the gaming infrastructure. As a result, the number of game servers will be higher during peak playing times, and the number of game servers will be lower during off-peak hours. In one embodiment, the increase or decrease of bandwidth is executed automatically, based on current line usage or based on historical data.

One or more social network management servers 462 provide support for the social features incorporated into the online games. The social network management servers 462 access social data 478 from one or more social networks 474 via Application Programming Interfaces (API) 472 made available by the social network providers. An example of a social network is Facebook, but it is possible to have other embodiments implemented in other social networks. Each social network 474 includes social data 478, and this social data 478, or a fraction of the social data, is made available via API 472. As in the case of the game servers, the number of social network management servers 462 that are active at a point in time changes according to the load on the infrastructure. As the demand for social data increases, the number of social network management servers 462 increases. Social network management servers 462 cache user data in database 468, and social data in database 470. The social data may include the social networks where a player is present, the social relationships for the player, the frequency of interaction of the player with the social network and with other players, etc. Additionally, the user data kept in database 468 may include the player's name, demographics, e-mail, games played, frequency of access to the game infrastructure, etc.

It is noted that the embodiment illustrated in FIG. 8 is an exemplary online gaming infrastructure. Other embodiments may utilize different types of servers, databases, APIs, etc., and the functionality of several servers can be provided by a single server, or the functionality can be spread across a plurality of distributed servers. The embodiment illustrated in FIG. 8 should therefore not be interpreted to be exclusive or limiting, but rather exemplary or illustrative.

Figure 9:
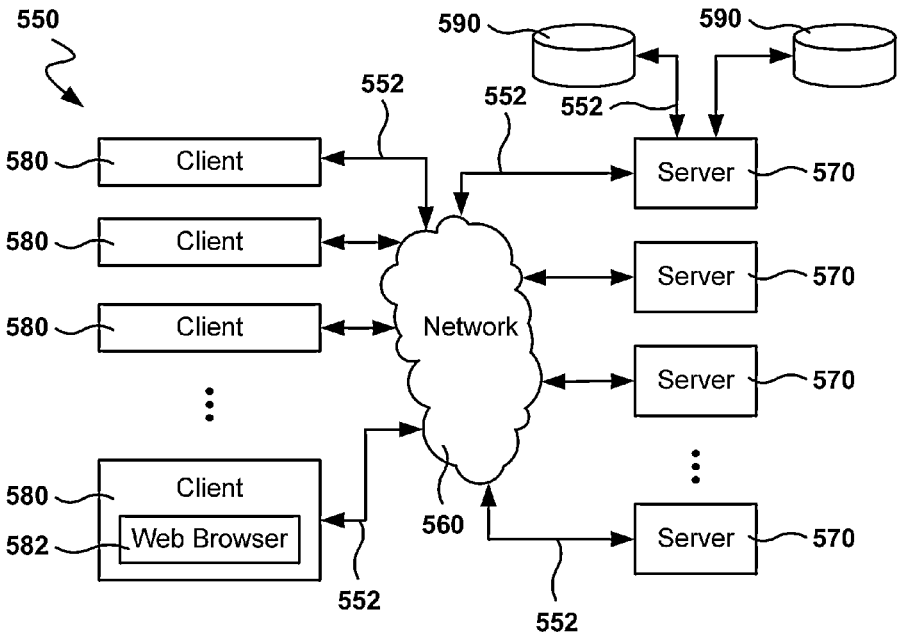
FIG. 9 illustrates an example network environment suitable for implementing embodiments.

FIG. 9 illustrates an example network environment 550 suitable for implementing embodiments. Network environment 550 includes a network 560 coupling one or more servers 570 and one or more clients 580 to each other. In particular embodiments, network 560 is an intranet, an extranet, a virtual private network (VPN), a local area network (LAN), a wireless LAN (WLAN), a wide area network (WAN), a metropolitan area network (MAN), a portion of the Internet, another network, or a combination of two or more such networks 560.

One or more links 552 couple a server 570 or a client 580 to network 560. In particular embodiments, one or more links 552 each includes one or more wired, wireless, or optical links 552. In particular embodiments, one or more links 552 each includes an intranet, an extranet, a VPN, a LAN, a WLAN, a WAN, a MAN, a portion of the Internet, or another link 552 or a combination of two or more such links 552.

Each server 570 may be a stand-alone server or may be a distributed server spanning multiple computers or multiple datacenters. Servers 570 may be of various types, such as, for example and without limitation, community server, web server, news server, mail server, message server, advertising server, file server, application server, exchange server, database server, or proxy server. Each server 570 may include hardware, software, embedded logic components, or a combination of two or more such components for carrying out the appropriate functionalities implemented or supported by server 570. For example, a web server is generally capable of hosting websites containing web pages or particular elements of web pages. More specifically, a web server may host HyperText Markup Language (HTML) files or other file types, or may dynamically create or constitute files upon a request, and communicate them to clients 580 in response to Hypertext Transfer Protocol (HTTP) or other requests from clients 580. A mail server is generally capable of providing electronic mail services to various clients 580. A database server is generally capable of providing an interface for managing data stored in one or more data stores.

In particular embodiments, one or more data storages 590 may be communicatively linked to one or more severs 570 via one or more links 552. Data storages 590 may be used to store various types of information. The information stored in data storages 590 may be organized according to specific data structures. In particular embodiments, each data storage 590 may be a relational database. Particular embodiments may provide interfaces that enable servers 570 or clients 580 to manage, e.g., retrieve, modify, add, or delete, the information stored in data storage 590.

In particular embodiments, each client 580 may be an electronic device including hardware, software, or embedded logic components or a combination of two or more such components and capable of carrying out the appropriate functionalities implemented or supported by client 580. For example and without limitation, a client 580 may be a desktop computer system, a notebook computer system, a notebook computer system, a handheld electronic device, or a mobile telephone. A client 580 may enable a network player at client 580 to access network 580. A client 580 may enable its player to communicate with other players at other clients 580. Further, each client 580 may be a computing device, such as a desktop computer or a work station, or a mobile device, such as a notebook computer, a network computer, or a smart telephone.

In particular embodiments, a client 580 may have a web browser 582, such as Microsoft Internet Explorer, Google Chrome, Or Mozilla Firefox, and may have one or more add-ons, plug-ins, or other extensions. A player at client 580 may enter a Uniform Resource Locator (URL) or other address directing the web browser 582 to a server 570, and the web browser 582 may generate a Hyper Text Transfer Protocol (HTTP) request and communicate the HTTP request to server 570. Server 570 may accept the HTTP request and communicate to client 580 one or more Hyper Text Markup Language (HTML) files responsive to the HTTP request. Client 580 may render a web page based on the HTML files from server 570 for presentation to the user. The present disclosure contemplates any suitable web page files. As an example and not by way of limitation, web pages may render from HTML files, Extensible Hyper Text Markup Language (XHTML) files, or Extensible Markup Language (XML) files, according to particular needs. Such pages may also execute scripts such as, for example and without limitation, those written in Javascript, Java, Microsoft Silverlight, combinations of markup language and scripts such as AJAX (Asynchronous Javascript and XML), and the like. Herein, reference to a web page encompasses one or more corresponding web page files (which a browser may use to render the web page) and vice versa, where appropriate.

Web browser 582 may be adapted for the type of client 580 where the web browser executes. For example, a web browser residing on a desktop computer may differ (e.g., in functionalities) from a web browser residing on a mobile device. A user of a social networking system may access the website via web browser 582.

Figure 10:
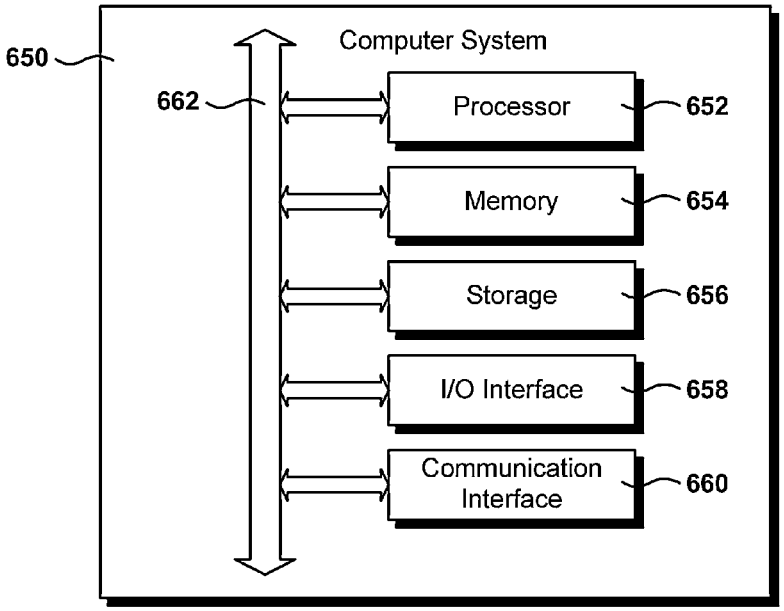
FIG. 10 illustrates an example computer system for implementing embodiments.

FIG. 10 illustrates an example computer system 650 for implementing embodiments. In particular embodiments, software running on one or more computer systems 650 performs one or more operations of one or more methods described or illustrated herein or provides functionality described or illustrated herein. Although methods for implementing embodiments were described with a particular sequence of operations, it is noted that the method operations may be performed in different order, or the timing for the execution of operations may be adjusted, or the operations may be performed in a distributed system by several entities, as long as the processing of the operations are performed in the desired way.

As example and not by way of limitation, computer system 650 may be an embedded computer system, a system-on-chip (SOC), a single-board computer system (SBC) (such as, for example, a computer-on-module (COM) or system-on-module (SOM)), a desktop computer system, a laptop or notebook computer system, an interactive kiosk, a mainframe, a mesh of computer systems, a mobile telephone, a personal digital assistant (PDA), a server, or a combination of two or more of these. Where appropriate, computer system 650 may include one or more computer systems 650; be stand-alone or distributed; span multiple locations; span multiple machines; or reside in a cloud, which may include one or more cloud components in one or more networks. The one or more computer systems 650 may perform in real time or in batch mode one or more operations of one or more methods described or illustrated herein.

In particular embodiments, computer system 650 includes a processor 652, memory 654, storage 656, an input/output (I/O) interface 658, a communication interface 660, and a bus 662. Although this disclosure describes and illustrates a particular computer system having a particular number of particular components in a particular arrangement, embodiments may be implemented with any suitable computer system having any suitable number of any suitable components in any suitable arrangement.

In particular embodiments, processor 652 includes hardware for executing instructions, such as those making up a computer program. As an example and not by way of limitation, to execute instructions, processor 652 may retrieve (or fetch) the instructions from an internal register, an internal cache, memory 654, or storage 656; decode and execute them; and then write one or more results to an internal register, an internal cache, memory 654, or storage 656. The present disclosure contemplates processor 652 including any suitable number of any suitable internal registers, where appropriate. Where appropriate, processor 652 may include one or more arithmetic logic units (ALUs); be a multi-core processor; or include one or more processors 652. Although this disclosure describes and illustrates a particular processor, this disclosure contemplates any suitable processor.

In particular embodiments, memory 654 includes main memory for storing instructions for processor 652 to execute, or data that can be manipulated by processor 652. As an example and not by way of limitation, computer system 650 may load instructions from storage 656 or another source (such as, for example, another computer system 650) to memory 654. Processor 652 may then load the instructions from memory 654 to an internal register or internal cache. During or after execution of the instructions, processor 652 may write one or more results (which may be intermediate or final results) to the internal register or internal cache. Processor 652 may then write one or more of those results to memory 654. One or more memory buses (which may each include an address bus and a data bus) may couple processor 652 to memory 654. Bus 662 may include one or more memory buses, as described below. One or more memory management units (MMUs) reside between processor 652 and memory 654 and facilitate accesses to memory 654 requested by processor 652. Memory 654 includes random access memory (RAM).

As an example and not by way of limitation, storage 656 may include a Hard Disk Drive (HDD), a floppy disk drive, flash memory, an optical disc, a magneto-optical disc, magnetic tape, or a Universal Serial Bus (USB) drive or a combination of two or more of these. Storage 656 may include removable or non-removable (or fixed) media, where appropriate. In particular embodiments, storage 656 includes read-only memory (ROM). Where appropriate, this ROM may be mask-programmed ROM, programmable ROM (PROM), erasable PROM (EPROM), electrically erasable PROM (EEPROM), electrically alterable ROM (EAROM), or flash memory or a combination of two or more of these.

In particular embodiments, I/O interface 658 includes hardware, software, or both providing one or more interfaces for communication between computer system 650 and one or more I/O devices. One or more of these I/O devices may enable communication between a person and computer system 650. As an example and not by way of limitation, an I/O device may include a keyboard, keypad, microphone, monitor, mouse, printer, scanner, speaker, still camera, stylus, tablet, touch screen, trackball, video camera, another suitable I/O device or a combination of two or more of these.

Communication interface 660 includes hardware, software, or both providing one or more interfaces for communication between computer system 650 and one or more other computer systems 650 on one or more networks. As an example and not by way of limitation, communication interface 660 may include a network interface controller (NIC) or network adapter for communicating with an Ethernet or other wire-based network or a wireless NIC (WNIC) or wireless adapter for communicating with a wireless network, such as a WI-FI network. As an example, computer system 650 may communicate with a wireless PAN (WPAN) (such as, for example, a BLUETOOTH WPAN), a WI-FI network, a WI-MAX network, a cellular telephone network (such as, for example, a Global System for Mobile Communications (GSM) network), or other suitable wireless network or a combination of two or more of these.

In particular embodiments, bus 662 includes hardware, software, or both coupling components of computer system 650 to each other. As an example and not by way of limitation, bus 662 may include an Accelerated Graphics Port (AGP) or other graphics bus, an Enhanced Industry Standard Architecture (EISA) bus, a front-side bus (FSB), a HYPERTRANSPORT (HT) interconnect, an Industry Standard Architecture (ISA) bus, an INFINIBAND interconnect, a low-pin-count (LPC) bus, a memory bus, a Micro Channel Architecture (MCA) bus, a Peripheral Component Interconnect (PCI) bus, a PCI-Express (PCI-X) bus, a serial advanced technology attachment (SATA) bus, a Video Electronics Standards Association local (VLB) bus, or another suitable bus or a combination of two or more of these. Bus 662 may include one or more buses 662, where appropriate. Although this disclosure describes and illustrates a particular bus, this disclosure contemplates any suitable bus or interconnect.

Herein, reference to a computer-readable storage medium encompasses one or more non-transitory, tangible computer-readable storage media possessing structure that may store a computer program or data. As an example and not by way of limitation, a computer-readable storage medium may include a semiconductor-based or other integrated circuit (IC) (such, as for example, a field-programmable gate array (FPGA) or an application-specific IC (ASIC)), a hard disk, an HDD, a hybrid hard drive (HHD), an optical disc, an optical disc drive (ODD), a magneto-optical disc, a magneto-optical drive, a floppy disk, a floppy disk drive (FDD), magnetic tape, a holographic storage medium, a solid-state drive (SSD), a RAM-drive, a Secure Digital card, a Secure Digital drive, or another suitable computer-readable storage medium or a combination of two or more of these, where appropriate. Herein, reference to a computer-readable storage medium excludes any medium that is not eligible for patent protection under 35 U.S.C. § 101.

One or more embodiments can also be fabricated as computer readable code on a non-transitory computer readable medium. Herein, reference to software may encompass one or more applications, bytecode, one or more computer programs, one or more executables, one or more instructions, logic, machine code, one or more scripts, or source code, and vice versa, where appropriate.

The present disclosure encompasses all changes, substitutions, variations, alterations, and modifications to the example embodiments herein that a person having ordinary skill in the art would comprehend.

What is claimed is:

1. A method comprising:

providing, by one or more servers, an interface to be displayed on a display of a user device to a first player for playing a poker game;

detecting, by the one or more servers, an all-in bet by one of the players in the poker game and that the all-in bet is not enough to cover a bet from another player, wherein the one or more servers interface with a game database for said detecting the all-in bet by one of the players and that the all-in bet is not enough to cover the bet from another player and wherein the one or more servers interconnects the players of the poker game via a network;

creating, by the one or more servers in response to the detecting, a side pot in the poker game for players that can bet above the all-in bet;

sending, by the one or more servers to the user device, data for displaying within the interface, the side pot in a first format after creating the side pot, the first format including an amount of the side pot but not including an indication of each player participating in the side pot, the first format not enabling the first player to view which players are participating in the side pot;

detecting, by the one or more servers, a selection by the first player in the poker game requesting additional information about the side pot;

creating, by the one or more servers, an individualized view configuration for the first player of the side pot based on spatial relationships of the players participating in the side pot with respect to the first player, the one or more servers interface with the game database to map respective icons of the players participating in the side pot to positions within the individualized view configuration that correspond to their respective spatial relationships with respect to the first player;

sending, by the one or more servers to the user device in response to the selection, data for presenting the side pot in a second format within the interface that is displayed on the display of the user device based on the individualized view configuration, the second format being less compact within the interface than the first format, the second format having the amount of the side pot and respective icons of the players participating in the side pot, wherein the second format hides players not participating in the side pot from view so that the first player is provided with a specific view of the players participating in the side pot;

wherein operations of the method are executed by a processor of the one or more servers, and wherein the one or more servers communicate with a social network via an application programming interface to obtain data associated with the players of the poker game, and wherein avatars of each of the players of the poker game are displayed with respective timers that are configured to graphically represent an amount of time remaining for the respective players to perform an action during a turn of the respective players.

2. The method as recited in claim 1, wherein the selection by the first player includes an input from one of a mouse click on the side pot, or a mouse cursor hovering over the side pot, or a touch on a touchscreen on the side pot.

3. The method as recited in claim 1, further including:

detecting a second selection by the first player; and presenting, in response to the second selection, the side pot in the first format.

4. The method as recited in claim 1, wherein the individualized view configuration for the first player is different than an individualized view configuration for a second player based on differences between respective spatial relationships of the players participating in the side pot with respect to the first player and the second player.

5. The method as recited in claim 1, wherein presenting the side pot in the second format further includes:

displaying icons around a poker table associated with players participating in the side pot in a first icon format; and displaying icons around the poker table associated with players not participating in the side pot in a second icon format.

6. The method as recited in claim 5, wherein the first icon format includes one of expanding a size of the icon, or putting a ring around the icon, or flashing the icon, or leaving the icon unchanged.

7. The method as recited in claim 5, wherein the second icon format includes hiding the icon, or graying out the icon, or making the icon transparent, or shrinking the icon.

8. The method as recited in claim 1, further including:

detecting that a player participating in the side pot has folded; and no longer presenting an icon of the player that has folded when presenting the side pot in the second format.

9. The method as recited in claim 1, further including:

detecting an end of a poker hand;

determining that a player participating in the side pot has won the side pot; and highlighting an icon of the player participating in the side pot that has won in the second format.

10. A method comprising:

providing, by one or more servers, an interface to be displayed on a display of a user device to a first player for playing a poker game with other players, each player of the poker game having an icon for display in the interface;

detecting, by the one or more servers, an all-in bet by one of the players in the poker game and that the all-in bet is not enough to cover a bet from another player, wherein the one or more servers interface with a game database for said detecting the all-in bet by one of the players and that the all-in bet is not enough to cover the bet from another player and wherein the one or more servers interconnects the players of the poker game via a network;

creating, by the one or more servers in response to the detecting, a first side pot for players that can bet above the all-in bet;

creating, by the one or more servers, a second side pot in the poker game;

creating, by the one or more servers, an individualized view configuration of the first side pot and the second side pot for the first player based on spatial relationships of the players participating in the first side pot and the second side pot with respect to the first player, the one or more servers interface with the game database to map respective icons of the players participating in the first side pot and the second side pot to positions within the individualized view configuration that correspond to their respective spatial relationships with respect to the first player;

sending, by the one or more servers to the user device, data for displaying within the interface, the first side pot and the second side pot in a first format, the first format including an amount of a respective side pot but not including respective icons of each player participating in the respective side pot, the first format not enabling the first player to view which players are participating in the side pot;

detecting, by the one or more servers, a selection by the first player in the poker game requesting additional information about the first side pot; and sending, by the one or more servers to the user device, data for displaying within the interface in response to the selection, the first side pot in a second format based on the individualized view configuration, the second format having more details about the side pot than the first format, the second format having the amount of the first side pot and respective icons of the players participating in the first side pot, wherein the second format hides players not participating in the first side pot from view so to that first player is provided with a specific view of the players participating in the first side pot;

wherein operations of the method are executed by a processor of the one or more servers, and wherein the one or more servers communicate with a social network via an application programming interface to obtain data associated with the players of the poker game, and wherein avatars of each of the players of the poker game are displayed with respective timers that are configured to graphically represent an amount of time remaining for the respective players to perform an action during a turn of the respective players.

11. The method as recited in claim 10, wherein selecting any of the side pots, while the side pots are presented in the first format, causes the presentation of all the side pots in the second format.

12. The method as recited in claim 11, wherein selecting any of the side pots, while the side pots are presented in the second format, causes the presentation of all the side pots in the first format.

13. The method as recited in claim 10, wherein selecting any of the side pots causes the selected side pot to be presented in the first format and a remainder of the side pots to be presented in the second format.

14. The method as recited in claim 10, further including:

detecting a second selection by the first player, the second selection being associated with a main pot; and presenting all the side pots in the second format in response to the second selection.

15. The method as recited in claim 10, wherein operations of the method are performed by a computer program when executed by one or more processors, the computer program being embedded in a non-transitory computer-readable storage medium.

16. A non-transitory computer-readable storage medium storing a computer, the computer-readable storage medium comprising:

program instructions for providing, by one or more servers, an interface to be displayed on a display of a user device to a first player for playing a poker game;

program instructions for detecting, by the one or more servers, an all-in bet by one of the players in the poker game and that the all-in bet is not enough to cover a bet from another player, wherein the one or more servers interface with a game database for said determining the all-in bet by one of the players and that the all-in bet is not enough to cover the bet from another player and wherein the one or more servers interconnects the players of the poker game via a network;

program instructions for creating, by the one or more servers in response to the detecting, a side pot in the poker game for players that can bet above the all-in bet;

program instructions for creating, by the one or more servers, an individualized view configuration for the first player of the side pot based on spatial relationships of the players participating in the side pot with respect to the first player, the one or more servers interface with the game database to map respective icons of the players participating in the side pot to positions within the individualized view configuration that correspond to their respective spatial relationships with respect to the first player;

program instructions for creating, by the one or more servers, an interactive area in the interface associated with the side mot, the interactive area presenting a compact format with information about the side pot, the compact format including an amount of the side pot but not including an indication of each player participating in the side pot, the compact format not enabling the first player to view which players are participating in the side pot; and program instructions for sending, by the one or more servers to the user device, in response to a selection by the first player in the poker game, data for displaying the interactive area in an expanded format based on the individualized view configuration, the interactive area in expanded format occupying a larger space within the interface than the interactive area in compact format, the expanded format including the amount of the side pot and an icon for each the respective icons of the player participating in the side pot, the expanded format hiding players not participating in the side pot from view and enabling the first player to specifically view which players are participating in the side pot;

wherein players not participating in the side pot are not presented in the expanded format, and wherein the one or more servers communicate with a social network via an application programming interface to obtain data associated with the players of the poker game, and wherein avatars of each of the players of the poker game are displayed with respective timers that are configured to graphically represent an amount of time remaining for the respective players to perform an action during a turn of the respective players.

17. The storage medium as recited in claim 16, wherein a poker hand starts with players placing bets for a main pot, wherein the side pot is created when one of the players has insufficient funds to cover a bet from another player.

18. The storage medium as recited in claim 16, further including:

providing an animation during play for a turn of a second player, the animation including a timer indicating an amount of time left for the second player to bet, the timer being overimposed over an icon of the second player.

19. The storage medium as recited in claim 18, wherein the timer covers the icon of the second player, wherein the timer is one of opaque or semitransparent.

20. The method as recited in claim 1, wherein the icon for each of the player presented in the second format includes a picture from a profile of the respective player.

21. The method as recited in claim 1, wherein the respective timers are over imposed on the respective avatars of the player such that when a turn of the player begins, the avatar is completely visible and as time progresses the timer starts occluding a view of the avatar in circular fashion, and wherein when the avatar is entirely occluded, the turn of the player has expired.

22. The method as recited in claim 10, wherein the respective timers are over imposed on the respective avatars of the player such that when a turn of the player begins, the avatar is completely visible and as time progresses the timer starts occluding a view of the avatar in circular fashion, and wherein when the avatar is entirely occluded, the turn of the player has expired.

23. The method as recited in claim 16, wherein the respective timers are over imposed on the respective avatars of the player such that when a turn of the player begins, the avatar is completely visible and as time progresses the timer starts occluding a view of the avatar in circular fashion, and wherein when the avatar is entirely occluded, the turn of the player has expired.

* * * * *